US005580410A

United States Patent [19]

Johnston

[11] Patent Number: 5,580,410

[45] Date of Patent: Dec. 3, 1996

[54] PRE-CONDITIONING A SUBSTRATE FOR ACCELERATED DISPERSED DYE SUBLIMATION PRINTING

[75] Inventor: Kenneth Johnston, Richmond, Va.

[73] Assignee: Delta Technology, Inc., Richmond, Va.

[21] Appl. No.: 356,066

[22] Filed: Dec. 14, 1994

[51] Int. Cl.[6] ..... B44C 1/17

[52] U.S. Cl. ..... 156/240; 156/381; 156/238; 156/230; 156/277; 8/470; 8/471

[58] Field of Search ..... 156/381, 240, 156/238, 230, 277; 8/471, 470, 472, 469

[56] References Cited

U.S. PATENT DOCUMENTS

| | | | |
|---|---|---|---|
| 3,079,309 | 2/1963 | Wainer | 204/35 |
| 3,193,416 | 7/1965 | Michelson | 148/6.1 |
| 3,264,158 | 8/1966 | Howe | 156/230 |
| 3,363,557 | 1/1968 | Blake | 101/470 |
| 3,380,831 | 4/1968 | Cohen et al. | 96/115 |
| 3,484,342 | 12/1969 | Blake et al. | 204/18 |
| 3,524,799 | 8/1970 | Dale | 204/58 |
| 3,574,049 | 4/1971 | Sander | 161/220 |
| 3,632,291 | 1/1972 | Defago et al. | 8/2.5 |
| 3,649,332 | 3/1972 | Dybvig | 117/38 |
| 3,652,429 | 3/1972 | Deltombe . | |
| 3,707,346 | 12/1972 | Markert et al. | 8/2.5 |
| 3,784,355 | 1/1974 | Fielding | 8/175 |
| 3,792,968 | 2/1974 | Rickenbacher et al. | 8/2.5 |
| 3,813,218 | 5/1974 | de Plasse | 8/2.5 |
| 3,829,286 | 8/1974 | Anzai et al. | 8/2.5 |
| 3,846,069 | 11/1974 | Angliker et al. | 8/2.5 |
| 3,860,388 | 1/1975 | Haigh | 8/2.5 |
| 3,952,131 | 4/1976 | Sideman | 428/334 |
| 3,969,071 | 7/1976 | Hugelin | 8/2.5 R |
| 3,994,146 | 11/1976 | Murase | 68/5 C |
| 4,021,591 | 5/1977 | DeVries et al. | 428/200 |
| 4,029,467 | 6/1977 | Defago et al. | 8/2.5 A |
| 4,059,471 | 11/1977 | Haigh | 156/244 |
| 4,063,878 | 12/1977 | Weeks | 8/2.5 A |
| 4,076,494 | 2/1978 | Schuster et al. | 8/2.5 A |
| 4,177,299 | 12/1979 | Severus et al. | 8/471 X |
| 4,201,821 | 5/1980 | Fromson et al. | 428/203 |
| 4,202,663 | 5/1980 | Haigh et al. | 8/471 |
| 4,253,838 | 3/1981 | Mizuno et al. | 8/471 |
| 4,312,686 | 1/1982 | Smith et al. | 156/277 X |
| 4,351,871 | 9/1982 | Lewis et al. | 428/195 |
| 4,352,721 | 10/1982 | Park et al. | 8/471 X |
| 4,411,667 | 10/1983 | Meredith et al. | 8/471 |
| 4,451,335 | 5/1984 | Woods et al. | 204/35 N |
| 4,465,728 | 8/1984 | Haigh et al. | 428/156 |
| 4,504,837 | 3/1985 | Toyoda et al. | 156/240 X |

(List continued on next page.)

FOREIGN PATENT DOCUMENTS

| | | | |
|---|---|---|---|
| 3010532A1 | 9/1981 | Germany | 8/471 |

OTHER PUBLICATIONS

C. E. Vellins, "Transfer Printing", L. B. Holliday & Co., Ltd., Chapter V. pp. 191–220, 1978.

Mattiello, "Protective And Decorative Coatings". Emulsions, John Wiley & Sons, 1945, pp. 277–361.

*Primary Examiner*—James Engel
*Assistant Examiner*—Steven J. Helmer
*Attorney, Agent, or Firm*—Foley & Lardner

[57] ABSTRACT

A dispersed dye sublimation imaging method of a substrate includes a pre-conditioning step, before the substrate is imaged, which uses controlled heat and humidity. The pre-conditioning step, by raising the surface energy levels of the substrate and thermally stabilizing the substrate before pressured contact in the imaging zone, allows for more precise control of dye sublimation during image. Pre-conditioning also allows: the use of higher temperature dyes; the use of higher temperatures and shorter dwell times in the imaging zone; and/or the use of lower imaging temperatures. The pre-conditioning also provides for greater migration and penetration of the dispersed dye into the surface of the substrate being imaged. The shorter dwell time and thermally stabilized pre-conditioned substrate also reduces movement between the substrate and dye carrier device, which provides for increased resolution of the imaged substrate.

23 Claims, 5 Drawing Sheets

U.S. PATENT DOCUMENTS

| | | | |
|---|---|---|---|
| 4,541,340 | 9/1985 | Peart et al. | 101/470 |
| 4,576,610 | 3/1986 | Donenfeld | 8/471 |
| 4,587,155 | 5/1986 | Durand | 428/195 |
| 4,619,665 | 10/1986 | Sideman et al. | 8/402 |
| 4,794,027 | 12/1988 | Hering | 428/68 |
| 4,977,136 | 12/1990 | Fujiwara et al. . | |
| 5,177,053 | 1/1993 | Nagura et al. . | |
| 5,234,983 | 10/1993 | Valenty . | |
| 5,256,623 | 10/1993 | Fukuda . | |

PRE-CONDITIONING A SUBSTRATE FOR ACCELERATED DISPERSED DYE SUBLIMATION PRINTING

BACKGROUND OF THE INVENTION

1. Field of the Invention

The present invention relates to efficient pre-conditioning of a substrate, which provides for improved imaging by the sublimation of a dye from a dye carrier device into the surface of a substrate. The present invention imparts and embeds a concentrated colored image, design or pattern from the dye carrier device into the surface of the substrate being imaged. The substrates can include plastics, aluminum, steel, textiles, paperboard, wood, coatings, leather. The imaged substrate has high resolution and may be used, for example, as decorative panels, containers or devices, or as packaging products.

2. Description of the Related Art

Sublimation printing is known in the art. See, for example, U.S. Pat. No. 3,363,557. In carrying out a sublimation printing, a temporary support, such as a carrier or transfer sheet has a sublimable ink and other components applied thereto. Application of the ink can take place by a number of well known techniques such as rotogravure, offset or flexographic printing. The temporary support carrying a sublimable ink composition is brought into contact with the substrate, generally a textile material, although other substrates such as plastics are also known. Heat and pressure are generally supplied which causes the dispersed dyes in the ink to sublimate and migrate from the temporary support into the substrate being processed.

The sublimable inks used in sublimation printing, such as those described in U.S. Pat. No. 3,829,286 are generally known in the art. The inks generally include a dye material, solvent, binders and other conventional ink additives well known to those skilled in the art. Likewise, the use of a temporary support for carrying a sublimable dye, as described in U.S. Pat. Nos. 3,860,388, 3,829,286, 4,576,610 and 4,619,665 is generally known in the art. The temporary support typically includes a flexible support, such as paper, which can resist the heat incurred during the sublimation process. The paper may also include a release layer to prevent ink from permanently adhering to the support. The temporary support is then coated with a sublimable ink in the desired pattern. In some instances a layer of a thermoplastic film or sheet placed between the printed support and the dye receptor (substrate), or a coating may be applied over the sublimable ink, to allow the ink to pass therethrough during the sublimation stage.

U.S. Pat. Nos. 3,860,388, 4,202,663 and 3,994,146 all teach coloration or printing with sublimable dyes, which can include a step of heating before sublimation by the dyes. While such heating before sublimation printing is generally known, as shown by the above patents, the known methods of printing or coloration do not thermally stabilize or increase the surface energy levels of the substrate prior to heated pressured contact of the substrate and temporary support. These methods require higher processing temperatures and increased dwell times, which eliminates use of low temperature stable substrates due to discoloration, melting, or other material failure. These methods also cause sympathetic dye migration, also known in the art as the Venturi or halo effect. This results in a color, design or pattern in the substrate which suffers from long processing times, limited resolution, limited wear resistance, limited color concentration, and limited selection of base plastics able to withstand the heat requirements of the current known processes for sublimation.

SUMMARY OF THE INVENTION

One object of the present invention is to provide a method for imaging a substrate which overcomes the disadvantages of the known art. Another object of the present invention is to provide a method which allows for more precise control of dye sublimation during dispersed dye sublimation printing. Another object of the present invention is to provide a method for imaging a substrate which allows material substrates that do not have the high temperature resistance required for known dye sublimation methods to be imaged at lower temperatures. Still another object of the present invention is to provide a method which allows high temperature dyes to be used at lower temperatures than conventionally required in sublimation imaging.

Yet another object of the invention is to provide a method process which allows a substrate to be imaged in a shorter dwell time than is conventionally required in an imaging process. The shorter dwell time allows substrates to be imaged at temperatures which would lead to substrate failure in known sublimation imaging processes. Another object of the present invention is to provide a method which thermally stabilizes a substrate before a dye carrier device is brought into contact with the substrate. The thermal stabilization leads to higher resolution images due to decreased movement between the thermally stabilized substrate and dye carrier device. Still another object of the present invention is to provide a pre-conditioning of materials before thermal imaging to provide a broader range/selection of both dispersed dyes as well as materials which can be used in the imaging process.

Yet another object of the present invention is to provide a method for imaging which increases the surface energy of a substrate before imaging. The increased surface energy opens pores of the substrate surface and allows greater penetration of sublimated dyes which allows increased color concentration of the imaged substrate.

Another object of the present invention is to provide an improved ink composition which can be used with the imaging process of the present invention. Still another object of the present invention is to provide an imaged substrate produced by the method of the present invention, and which exhibits the qualities of high resolution (sharpness), high concentration of colors (vivid colors), high resistance to wear and solvents, high light fastness and high thermal stability.

In accomplishing the foregoing objects, there has been provided according to one aspect of the present invention a method for imaging a substrate with a dispersed dye. The method comprises the steps of: (i) introducing at least one substrate into a controlled heat and humidity pre-conditioning zone, wherein the pre-conditioning zone is substantially at or less than atmospheric pressure; (ii) heating the at least one substrate in the conditioning zone at a temperature and humidity and for a time sufficient to increase the surface energy levels of the at least one substrate to accelerate and optimize absorption of dyes; (iii) transporting the resultant at least one conditioned substrate and at least one dye carrier device carrying at least one ink composition containing at least one sublimable dye into a controlled thermal imaging zone; (iv) applying pressure to the at least one substrate and dye carrier device to bring the at least one substrate and dye carrier device into intimate pressured contact, and applying heat to effect the migration and penetration of the at least one dye from the at least one dye carrier device to the at least one substrate by sublimation to produce at least one imaged substrate; (v) transporting the at least one imaged substrate to a stabilization zone; and (v) cooling the at least one imaged substrate in said stabilization zone.

In a preferred embodiment, the pre-conditioning zone and/or the imaging zone is maintained under a vacuum or in an atmosphere of an inert gas. This prevents burning/discoloration of the substrate and dye carrier device and improves the light fastness of the imaged substrate.

There has also been provided according to another aspect of the present invention, a novel ink composition which has been found to work especially well with the pre-conditioning and imaging method of the present invention. The ink composition according to the present invention includes both aqueous and hydrophobic inks. The aqueous ink composition according to the present invention generally includes 5 to 30, preferably 10 to 20, most preferably 15 parts of a dispersed dye; 5 to 30, preferably 10 to 20, most preferably 15 parts of a binder, 2 to 20, preferably 5 to 15, most preferably 10.5 parts of a water soluble organic solvent; 0.1 to 3, preferably 0.3 to 1, most preferably 0.5 parts of an anti-foaming agent; and 30 to 80, preferably 40 to 70, most preferably 58 parts of water. All parts are given in parts by weight.

The hydrophobic ink composition according to the present invention generally includes 5 to 30, preferably 10 to 20, most preferably 15 parts of a dispersed dye; 2 to 20, preferably 5 to 15, most preferably 10 parts of a binder; 1 to 12, preferably 2 to 8, most preferably 4 parts of a polyfunctional fixing agent; 1 to 8, preferably 2 to 6, most preferably 4 parts water; and 30 to 80, preferably 40 to 70, most preferably 57 parts of an organic solvent.

In another preferred embodiment, the dye particles used in the ink composition have an average particle size of about 0.1 to about 1 μm, preferably ≦ about 0.5 μm.

There has also been providing according to another aspect of the present invention, an imaged substrate which is produced by the method of the present invention.

Further objects, features and advantages of the present invention will become apparent from the detailed description which follows.

BRIEF DESCRIPTION OF THE DRAWINGS

Whenever possible, the same reference numbers will be used throughout the drawings to refer to the same features.

DETAILED DESCRIPTION OF THE PREFERRED EMBODIMENTS

The following terms used throughout the disclosure are defined as follows. A "substrate" is defined as any material or coated material which is capable of accepting a sublimed dye. The substrate can be webs, sheets, coils, or three-dimensional objects, such as containers. The substrate materials can include, inter alia, textiles, coated textiles, blends of textiles, leather, synthetic leather, paper, wood, polymers, blends of polymers, metals such as anodized aluminum, coated steel, glass or coated glass and any coating and other materials that can be imaged with a sublimable dye. These materials are discussed in detail below.

The term "sublimable" or "sublimation" is defined as the conversion of a solid dye particle to a gaseous or vapor state. The term "sublimation" is also used interchangeably with the term "vaporization" in the printing art as describing a process by which the dye migrates from the dye carrier as a vapor or gas to the substrate, even though the two terms describe different thermodynamic phenomena of a solid particle converting to a vapor or gas. The migration or sublimation process is also called vapor phase printing, a process which includes the absorption and penetration of dye into the surface of the substrate.

Figure 1:
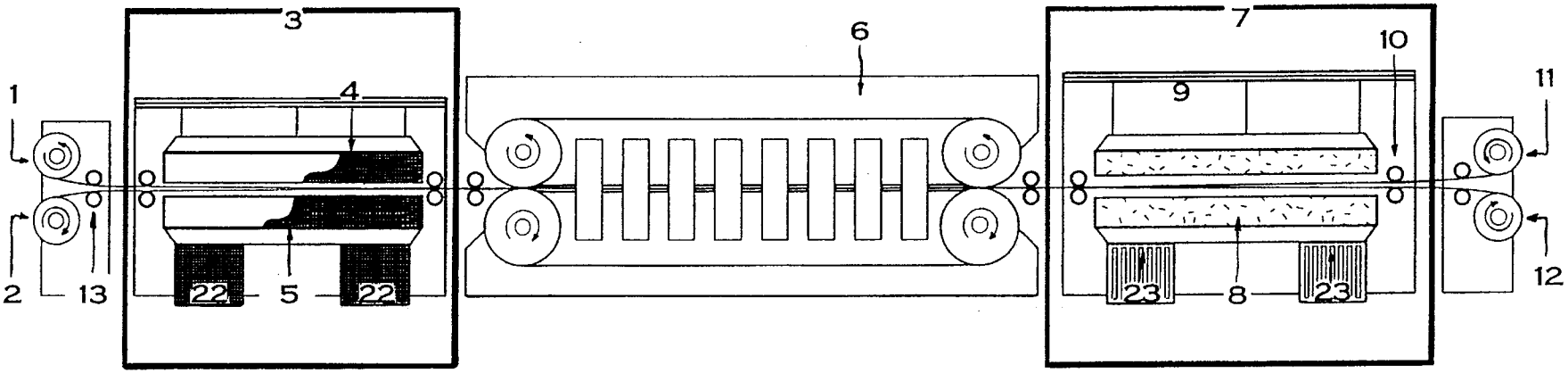
FIG. 1 illustrates a side view of a pre-conditioning and imaging system for imaging one side of a continuous substrate where the substrate and the dye carrier are pre-conditioned.

FIG. 1 illustrates one embodiment of the present invention. A continuous substrate to be imaged is wound on a supply roll 1 and fed, together with a dye carrier device 2 having a dye containing ink composition printed thereon, into a pre-conditioning zone 3. Before entry into the pre-conditioning zone, the substrate and dye carrier device may be aligned by an alignment device 13 to provide proper registration between the dye carrier device and substrate. Although the dye carrier device and the substrate may be in contact, they are not in a intimate pressured contact.

The pre-conditioning zone 3 is maintained at a selected temperature to heat the substrate to increase the surface energy levels of the substrate which will facilitate dye migration and penetration into the surface of the substrate in the thermal imaging zone 6. The humidity and temperature are selectively controlled in the pre-conditioning zone 3 by heating such as upper 4 and lower 5 infrared emitters, dehumidifying units 22 and other known heating and dehumidifying devices. In the thermal imaging zone 6, the dye carrier device and substrate are brought into intimate pressured contact and heated at a sufficient time and temperature to effect sublimation, migration and penetration of the dye or dyes from the dye carrier device into the surface of the pre-conditioned substrate.

After imaging, the material and dye carrier device may be transported to a stabilization zone 7 having an upper 9 and lower partition 8, where they are preferably cooled by cooling units 23 to room temperature and separated 10. The imaged substrate may be wound onto take-up roll 11 or retrieved for future use. The used dye carrier device may be wound onto take up roll 12 or retrieved for possible re-use.

Each individual feature of the present invention will now be described in detail below with reference to the attached drawings where appropriate.

While any ink compositions which contain sublimable dyes and are known to those skilled in the art can be used according the present invention, preferred inks according to the present invention include dyes selected from the azo, anthraquinone, nitroarylamine, styryl, quinophthalone derivatives and perinones family of dyes. The preferred ink compositions also include ink additives, such as binders, solvents, anti-foaming agents, thickeners, optical brighteners polyfunctional fixing agents, swelling agents, plasticizers, high boiling point solvents, blocking agents and other ink additives.

The binders include nitrocelluloses, cellulose ethers, ethyl cellulose and resins. Other known binders may also be used. The resins include colophony resins, hydrogenated colophony resins, di or polymerized colophony as calcium or zinc salts with colophony esterified with mono or polyvalent alcohols or with resinifiers such as acrylic acid and butanediol and phenol resins modified with colophony. The resins further include acrylic compound resins, maleinated resins, oil-free alkyd resins, styrolated alkyd resins, vinyl toluene modified alkyd resins, alkyd resins with synthetic fatty acids, linseed oil alkyd resin, ricinine oil alkyd resin, castor oil alkyd resin, soy oil alkyd resin, coconut oil alkyd resin and acrylated alkyd resin.

Further examples of preferred resins include terpene resins, polyvinyl resins such as polyvinyl acetate, polyvinyl chloride, polyvinylidene chloride, polyvinyl acetals, polyvinyl alcohol, polyvinyl ether, and copolymers and graft polymers with vinyl monomers. Other preferred resins include polyacrylic resins, acrylate resins, polystyrenes, polyisobutylenes polyesters based on phthalic acid, maleic acid, adipic acid and sebacic acid, naphthalene formaldehyde resins, furane resins, ketone resins, aldehyde resins, polyurethanes, and epoxide resins. Generally the resins are selected to match the affinity of the resin to the substrate being imaged. Styrolated alkyd resins, such as styrolated acrylic resins have been found to be especially preferable for a wide range of substrates.

The thickeners which are generally used for aqueous inks are generally used along with low molecular weight resins. The thickeners prevent agglomeration of the dye particles in the ink composition. The thickeners can include those known in the art. Preferred thickeners include polyvinyl alcohol, carob bean flour, methyl cellulose or water soluble polyacrylates.

Optical brighteners, which may be used in the ink compositions of the present invention, are generally employed to enhance the color of the various dyes being used. While any known optical brightener may be used, preferred optical brighteners include monazol, bisazol and benzoxazol derivatives.

Swelling agents, plasticizers, anti-foaming agents, polyfunctional fixing agents and high boiling point solvents may also be used to improve performance of the ink compositions according to the present invention. While any suitable agent may be used, preferred agents may include Tetralin and Decalin which are high boiling point solvents, maleic modified rosin ester which is a polyfunctional fixing agent, and ionic-nonionic surface active compounds which are condensation products of B-napthalinsulphonic acid with formaldehyde or partially desulphonated lignin sulphonate.

Organic solvents may also be used in the ink compositions according to the present invention. The solvents can include one or more of the following hydroxypropyl cellulose, propyl cellulose, benzyl ethoxyethyl cellulose, ethyl cellulose and mixtures of cellulose ethers containing ethyl or hydroxypropyl cellulose. Other solvents can include butyl acetate, acetone, methylethyl ketone, and lower molecular weight alcohols such as ethanol, isopropanol or butanol. Mixtures of the organic solvents may also be used.

Anhydrous organic solvents, which contain less than 15% water, may also be used as a solvent according to the present invention. The solvents can include halogenated or non-halogenated hydrocarbons of the aliphatic or aromatic series. These solvents include toluene, cyclohexane, petroleum ether, low molecular weight alcohols such as methanol, ethanol, propyl and isopropyl alcohols, esters of aliphatic acids, such as ethyl acetates, and ketones such as methyl ethyl ketone. Mixtures of these anhydrous organic solvents may also be used.

The blocking agent can generally include those known in the art. An especially suitable blocking agent includes polyethylenenimine (50% solids), sold under the trade name "Polyamine P" available from BASF Inc. The vehicle for carrying the blocking agent can include amine salts of strong acids, such as ethanolamine or diethanolamine salts of mineral acids. Other suitable amine compounds include p-toluene sulphonic acid with scarbazide, mono and diethanolamine.

The sublimable dyes particles can include those known in the dyeing art. Examples of these dyes include: Intratherm Dyes (Pink P-335NT, Yellow P-345NT, Yellow P-345NT, Yellow P-346, Brilliant Yellow P-348, Orange P-367, Scarlet P-356, Brilliant Red P-314NT, Brown P-301, Red P-339, Blue P-404, Blue P-305, and Brilliant Blue P-309); and Intrasil Dyes (Brilliant Yellow 10GF, Yellow UN-SE, Yellow 2GW, Yellow GFSW, Yellow Q-E, Yellow GWN 50%, Yellow 2R, Yellow 5R concentrate, Fast Yellow RLS 200%, Orange UN-SE, Orange RSE, Orange 2RA, Orange 2GR, Orange H-2GFS, Dark Orange 3GH concentrate, Orange YBLH, Brown 2RFL, Brown 3R, Scarlet 2R, Scarlet H-GF, Scarlet 2GH, Red MG, Red FTS, Red RB, Brilliant Pink 2GL, Pink SRL, Red BNA-SE, Brilliant Red 2B concentrate Grains, Red Q-E, Carmine UN-SE, Bordeaux 3BSF, Bordeaux 3BS-K, Rubine CK-GFL, Rubine H-RBS 150%, Rubine 4RBS, Violet FRL, Violet 2RB (INTRASPERSE), Dark Blue B-SE 200%, Blue R-AT, Blue FBL-N, Blue FRL-N, Blue Q-E, Blue BGL-N, Blue UN-SE, Blue GLF, Brilliant Blue BNA 200%, Brilliant Blue BNS, Blue GRA-E 200%, Navy ABBA, Navy Blue H-RS 200%, Black DS, Black RGH, Black MRS, Black CK, Black G-AT, Black RBFS 200%, Black ET 200%, Black PR, and Black FTF 150%). These dyes are readily available from Crompton and Knowles Corp., Charlotte, N. C. Further example of dyes include Subli Yellow 020A, Subli Red 022A, Subli Blue 021A, Subli Black 020A, and Subli Black 021A, available from Sicpa, Lausanne, Switzerland.

If two or more dyes are used according to the present invention, attention must be given to balance the sublimation characteristics or velocities of the dyes. This is accomplished by ensuring that the two or more dyes exhibit similar sublimation/vaporization characteristics or curves. Sublimation/vaporization curves are established by measuring the amount of dye subliming or vaporizing over a specified time at a specific temperature. Compatible dyes are selected when temperature, time, and sublimation rates are parallel in sequence with an established curve.

The average dye particle size available from the above sources is generally on the order of 1 to 15 μm. For use in a preferred embodiment of the present invention, the dye particles are further ground down to an average particle size on the order of 0.5 to 1 μm by grinding techniques, such as a ball mill, which are known per se. In addition, it has further been found that dye particles which are ground even further to have an average particle size of ≦0.5 μm, preferably 0.1 μm to 0.4 μm, provide a high concentration of dye in the imaged substrate, which in turn provides sharper, more vibrant images. To accomplish such a molecular particle size, the use of cryogenic grinding techniques are necessary to prevent sublimation and contamination of the dye particles during grinding.

As described above, the aqueous ink composition according to another aspect of the present invention generally includes 5 to 30, preferably 10 to 20, most preferably 15 parts of a dispersed dye; 5 to 30, preferably 10 to 20, most preferably 15 parts of a binder, 2 to 20, preferably 5 to 15, most preferably 10.5 parts of a water soluble organic solvent; 0.1 to 3, preferably 0.3 to 1, most preferably 0.5 parts of an anti-foaming agent; and 30 to 80, preferably 40 to 70, most preferably 58 parts of water. All parts are given in parts by weight. The preferred binder is styrolated acrylic resin. The preferred organic solvent is any lower molecular weight alcohol, such as isopropanol. Aqueous inks are preferably used in imaging for food, medical or other sensitive products where potential solvent contamination could adversely affect performance, such as potential taste contamination in cigarette packaging.

As also described above, the hydrophobic ink composition according to another aspect of the present invention generally includes 5 to 30, preferably 10 to 20, most preferably 15 parts of a dispersed dye; 2 to 20, preferably 5 to 15, most preferably 10 parts of a binder; 1 to 12, preferably 2 to 8, most preferably 4 parts of a polyfunctional fixing agent; 1 to 8, preferably 2 to 6, most preferably 4 parts water; and 30 to 80, preferably 40 to 70, most preferably 57 parts of an organic solvent. All parts are given in parts by weight. The preferred binder is ethylcellulose, the preferred polyfunctional fixing agent is maleic modified rosin ester. The preferred solvent is isopropanol.

The dye carrier device comprises a flexible support having the ink composition coated thereon in the desired pattern or image. Any combination of a flexible support and ink composition known to those skilled in the art can be used according to the present invention. Preferred combinations include flexible non-porous support known in the art and the novel ink compositions and dye particle sizes described above. Particularly preferred combinations include the novel ink compositions and dye particle sizes described above, and a flexible non-porous support selected from the group of 55 $g/m^2$ machine-glazed bleached kraft paper, silicone release paper, polypropylene coated paper, butylmethacrylate coated paper, isobutyl methacrylate copolymer coated paper, wax coated paper, polyvinyl butyral coated with butylmethacrylate coated paper. In addition, bone gelatin or protein coated paper may also be preferably used.

The ink compositions can be applied to the flexible support by conventional techniques such as silk screening, lithography, flexography and rotogravure techniques. In addition, specialized techniques such as bubble jet, electrostatic ink jet and laser printing methods may be advantageously used when limited production or a high resolution requirement is specified for the application. The resolution capabilities of the substrates imaged according to the present invention are described more fully below.

The printed flexible support may then be preferably coated with an incompatible film forming polymer, such as polyethylene. Although a thermoplastic or thermoset polymer may be individually used as the film forming polymer, a combination thereof is preferred. The thermoplastic polymer is selected for its elastomeric properties and surface control, whereas the thermoset polymer is selected to control/stabilize dye movement on the flexible support, by establishing linear boundaries when heated, which assists in controlling dye position on the dye carrier device. The film forming polymer also acts as a barrier/filter to prevent contaminants from passing from the dye carrier device to the pre-conditioned substrate during imaging. In addition, the film forming polymer helps preserve the ink composition on the dye carrier device during shipping and storage.

Introduction of the substrate and dye carrier device into the pre-conditioning zone or imaging zone may be carried out with the use of alignment devices where appropriate. These alignment devices are known in the art per se, and are used to ensure proper registration between the dye carrier device and the substrate to be imaged, should such proper registration become necessary for the finished product. For precision imaging, laser alignment is preferred.

The substrate is then placed into the pre-conditioning zone to effect an increase in thermal molecular activity or surface energy levels of the substrate which encourages/accelerates the migration and penetration of high concentrations of dye into the substrate surface in the thermal imaging zone. This increased surface energy provided by pre-conditioning the substrates has several advantages described below. The increase in the surface energy levels is accomplished by subjecting the substrate to controlled levels of heat and moisture. The moisture is expressed as relative humidity.

While not being bound by any theory, pre-conditioning substrates/materials through a controlled temperature/humidity zone is believed to deliver substrates to the thermal imaging device at their optimum condition or state of thermal molecular activity or surface energy to initiate immediate sublimation and penetration of disperse dyes from the dye carrier device into the substrate surface. This pre-conditioning allows for more precise control of dye sublimation during imaging and also provides several other distinct advantages over the known sublimation processes.

First, the pre-conditioning allows the user to select accelerated, i.e., shorter (such as 20–45 seconds) imaging process dwell times at high temperatures (such as 375° F.–425° F.); or second, the ability to process substrates at lower temperatures (such as 275° F.–375° F.) and accelerated dwell times (such as 30 seconds—one minute). The lower temperature process dwell time provides a broader range of substrates for thermal imaging that have not been considered possible through conventional disperse dye techniques. The imaging process and dwell time may be varied to each specific material being imaged.

Another advantage of this new material capability allows concentrated high energy/temperature (such as 375°–425° F.) disperse dyes which normally must be used at higher temperatures, to be used in low temperature resistant substrate materials for thermal imaging applications by providing the material surface energy developed in the pre-conditioning zone to drive the dye carrier device and material through their required dye sublimation energy curves to complete dye sublimation and penetration. The material surface energy developed in the pre-conditioning zone also drives the substrate material through its required thermal energy curve to open the pores of the substrate material which encourages penetration of the sublimated dyes into the surface of the substrate. Additional material advantages of pre-conditioning that are derived from this technique include enhanced brightness, color and gloss control, dimensional stability and resolution to produce a significantly improved finished product.

Another advantage that is achieved by the pre-conditioning of the substrate before imaging is that the expansion or contraction of a substrate that occurs as a substrate is heated will be complete by the end of the pre-conditioning process. By the time the substrate reaches the thermal imaging zone, the substrate will be dimensionally stable. In addition, the shortened dwell time provides a lower risk of movement between the dye carrier device and substrate during imaging.

This dimensional stability and reduced dwell time will reduce the probability of Venturi effects (image ghosting and shadowing) that would generally result from movement or vibration during imaging if pre-conditioning is not performed.

The substrate is preferably heated to just below the point where the surface of the substrate is compromised by deformation or degradation and within the temperature range to effect dye migration and penetration. This will allow the maximum surface energy levels for the greatest accelerated rate of dye migration and penetration. However, lower temperatures may be used for materials of lower temperature stability which will also raise the surface energy levels of the substrate and accelerate the migration and penetration of the dyes, but not to the extent of the higher temperatures. The pre-conditioning temperature range is very material-specific. The temperatures are generally in the range of about 180° F. to about 500° F. depending on the material being processed. Specific classes of materials are described in greater detail below. The heat can generally be applied by any suitable heating devices, such as infrared emitters, steam, hot oil, electric element, electron beam, radio frequency (RF) and lasers.

The pre-conditioning zone processing may also be carried out under a vacuum. When a vacuum is used, a conditioning structure that can hold a vacuum will be required. Such structures are generally known in the art. The vacuum prevents degradation, i.e., burning/discoloration that would normally occur under an atmosphere that contains oxygen. This allows the substrates to be pre-conditioned at higher temperatures for greater surface energy which provides for accelerated dye sublimation when the substrate is brought into pressured contact with the dye carrier device. In addition, use of a vacuum will also reduce the humidity levels in the pre-conditioning zone.

The pre-conditioning zone can also be operated under an inert atmosphere, such as nitrogen. By using an inert atmosphere, higher temperatures can be used for the same reasons as above, and lower levels of humidity will result.

The heat can be applied to either one or both sides of the substrate as shown in FIG. 1 to balance the expansion/contraction of the material and increase the surface energy of the substrate. The dye carrier device can also be heated (FIGS. 1, 2, 4 and 5). By heating the dye carrier in the pre-conditioning zone before imaging, less energy and heat will be required in the thermal imaging zone to bring the dyes on the carrier device up to the proper sublimation temperature while reducing processing time. However, as explained above, the substrate and dye carrier device should not be in intimate pressured contact. If desired, the dye carrier may also be heated in a different pre-conditioning zone than the substrate to optimize dye carrier performance (i.e., increase energy level of the dyes while preventing premature sublimation) and accelerate dye migration and penetration in the thermal imaging zone (FIG. 5).

The moisture level, expressed as relative humidity, in the conditioning zone is also preferably controlled. While not being bound by any theory, the control of humidity is believed to dry out the substrate, which facilitates the migration and penetration of dye into the substrate's surface. The relative humidity is preferably reduced by a dehumidifier that removes humidity from the air before the air enters the pre-conditioning zone. This dehumidification allows more flexibility and control of the relative humidity in the pre-conditioning zone. Alternatively, the relative humidity will be reduced by simply heating the substrate in the pre-conditioning zone with no additional dehumidification required.

In most applications, the humidity is controlled to provide ≦80 percent relative humidity, preferably 40–60 percent relative humidity. Very low humidities, such as those approaching zero percent relative humidity is desirable for most materials. However, for some materials such as polymers, very low relative humidity will result in the buildup of static electricity on the surface of the substrates which will interfere with the migration of the dyes into the surface of the polymers.

The structure used for pre-conditioning may generally be any type of housing device that is capable of enclosing the substrate and being heated, preferably an infrared industrial oven, such as an oven sold under the trademark "Black Body", manufactured by BBC Corp., Fenton, Mo. The pre-conditioning structure and process can be adapted for batch or continuous operation, i.e., a conveyor carrying discrete articles or a web.

After pre-conditioning, the substrate is transported from the pre-conditioning zone into the thermal imaging zone. The transport can be effected by any conventional means, such as a conveyor or a robotic arm. In some instances, the transport may even be made by hand. For a continuous web substrate undergoing continuous imaging, the transport and movement through the process can be effected by the take-up spool or reel at the end of the process.

In the thermal imaging zone, the dye carrier device and substrate are brought into an intimate pressured contact. Pressured contact is required to ensure sufficient and continued contact to enable the dyes to migrate and penetrate into the substrate during sublimation. The substrate is brought to a temperature and surface energy level necessary for sublimation and migration of the dyes from the dye carrier device to the substrate.

The applied pressure is generally about 1–100 psig, preferably 20–80 psig, depending on the substrate being processed. For a large variety of substrates, 40–60 psig, especially about 50 psig is most preferred. Specific pressures for specific materials are described in greater detail below.

The necessary pressure can be applied using any device that can apply a pressing force on the substrate and dye carrier device. Such devices include calendar rollers, hydraulic rams, pressure platens and other known pressure-applying devices. The pressure-applying device is preferably padded with a silicone, felt, Nomex and/or Teflon blanket or device to buffer the impact that the pressure applying device has with the substrate/dye carrier device.

In the thermal imaging zone, the substrate and dye carrier device are heated until the dye sublimation temperature is reached or the required energy curve of the dyes is completed. The temperature and energy required depends on the dye and substrate being imaged. As noted above, the dwell time in the thermal imaging zone will be reduced dramatically due to the pre-conditioning that optimizes the required surface energy levels for dye penetration. Another advantage of shorter dwell time, noted above, is that a dye having a higher sublimation temperature than the deformation or degradation temperature of a substrate can be used due to the material's increased surface energy and the reduced processing time during which the substrate will be exposed to energy and heat in the thermal imaging zone.

The imaging temperature is generally in the range from about 250° F. to about 500° F. depending on the material being imaged. The imaging temperatures of representative materials are described more fully below.

The source of heat in the thermal imaging zone may be heated rollers, static platens, infrared emitters, electric elements, hot oil, RF heating and lasers. Any other suitable source of heat capable of heating a dye to its sublimation temperature may also be used. The thermal imaging zone is preferably equipped with two zone (bottom/top) heating elements. This two zone arrangement allows balance of energy applied to both surfaces of materials and encourages dye migration and penetration.

Imaging can also be operated under a vacuum or inert gas, which prevents burning/discoloration and allows a high-temperature to be used than under an ambient atmosphere. This higher temperature also facilitates the use of high temperature dyes. The use of an inert atmosphere, particularly nitrogen, is also thought to increase the light fastness property of the imaged substrate.

In another preferred embodiment of the present invention, laser heating may be used to heat the dye composition to the dye sublimation point. The laser heating may be optionally enhanced by preparing the dye carrier device with a laser receptive coating on the reverse side. The laser heating occurs by directing a laser beam to the sublimable dyes. Since the laser is generally directed through the pressure applying device and dye carrier device, the pressure applying device and the dye carrier device are preferably transparent to laser radiation. A suitable laser transparent pressure applying device may include a specialized glass or other platen whose composition is transparent to laser radiation.

The laser can be programmed to selectively contact the sublimed dyes in a predetermined pattern to produce a selectively imaged substrate. Alternatively, a laseropaque mask such as a copper or titanium mask, or other suitable material, may be positioned between the laser source and the dye carrier device and the laser can be used for flood exposure of the mask.

After thermal imaging is complete, a rapid cooling stabilization is preferably employed to cease dye sublimation activity. The completion of imaging can be determined by visual inspection of or measuring the weight reduction of the dye carrier device after it has been removed from the thermal imaging zone. The stabilization allows the imaged substrate material to return to its ambient properties that it possessed before being imaged. The stabilization is preferably carried out in a separate cooling chamber to allow for rapid cooling, although natural cooling at room temperature itself may suffice. Rapid cooling is defined as lowering the temperature of the substrate from the thermal imaging temperature to either a temperature which dye sublimation activity ceases or preferably room temperature, usually in a range of 1 second to 5 minutes, preferably 1 second to 1 minute. The rate of cooling depends on the particular material that has been cooled. The separate cooling chamber may be any structure that is capable of reducing the temperature of the imaged substrate. Preferably, the cooling chamber is a refrigerated device of cooled platens which contact the substrate. The dye carrier device can be separated from the imaged substrate anytime after migration and penetration of dyes into the substrate is complete. The separation may take place before, during or after the stabilization Zone.

The final resolution of the imaged substrate is dependent on the resolution of the original image or design imparted on the dye carrier device. The final resolution is also dependent on mechanical techniques, such as the specialized cryogenic dye grinding described above, and selection of a dye particle structure that is capable of being ground by the specialized techniques. In addition the final resolution is dependent on the selective chemical formulation, such as binders that distribute and position the dye crystals in the ink composition.

For example, a dye carrier device that is printed with a resolution of 100 dots per inch will have an ink composition that has dye particle sizes of 0.6 to 1 μm and a standard binder to deliver an imaged substrate with a resolution of approximately 100 dots per inch according to the present invention. This ability to embedded an image having a substantially equal resolution to the dye carrier device is possible through the shorter dwell times and thermally stabilized material provided by the pre-conditioning process of the present invention described above.

If higher resolution is required, such as in the range of 200 to 300 dots per inch, the specialized grinding techniques described above may be used to provide an average dye particle size of 0.1 to 0.5 μm in the ink composition. This establishes a fine line, high resolution, concentrated dye within the same ink area, thereby providing an increased resolution capability. The binder selected for use with the concentrated dye, must evenly distribute the dye particles within the ink composition on the dye carrier device to provide a controlled migration from the dye carrier device to the substrate that is being imaged. This ability to embedded such a high resolution image to the substrate is provided through the shorter dwell times and thermally stabilized material produced by the pre-conditioning process according to the present invention.

Thus, using the preferred dye sizes and ink compositions of the present invention, along with the pre-conditioning of the substrate according to the present invention, provides a high resolution capability which can be defined as imaging capacity 200 to 300 dots per inch, or alternatively capable of imaging characters that can be clearly distinguished as small as four point type. This high degree of resolution will produce sharp, clear images with well defined boundaries comparable to camera quality.

Other printing techniques for printing the dye carrier device include continuous-tone printing which produces a continuous tone and full process color image. The continuous tone full process sublimation printing is achieved through successive layering of dyes to deliver the desired color value. The dyes are registered/printed onto the dye carrier device from ink that has a controlled dot size ranging from approximately 7 to 50 μm to create a continuous tone, full color image that will exhibit an image substrate surface devoid of dot patterns normally visible through conventional printing techniques. The ink dot size may be varied by the line value of the screen if a screen printing process is used, as well as etching techniques employed if a rotogravure process is used, or the orifice size of a bubble jet or ink jet device if an ink jet process is used to deliver the precise position and quantity of dye necessary to construct a high resolution image. Continuous tone sublimation imaging is further enhanced by pre-conditioning the substrate according to the present invention, because of the greater control of the materials and of dye sublimation and migration as compared to the known sublimation printing techniques.

Figure 2:
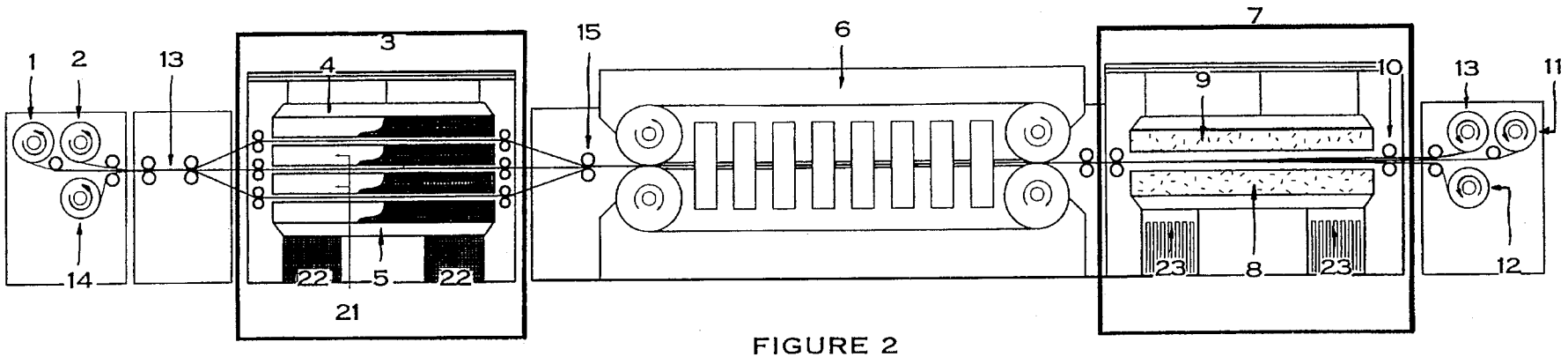
FIG. 2 illustrates a side view of a pre-conditioning and imaging system for two sided imaging of a continuous substrate.

FIG. 2 illustrates an embodiment of the present invention, where registered two-sided imaging of the substrate is carried out. In addition to the dye carrier 2 illustrated in FIG. 1, an additional dye carrier 14 is provided. The two dye carriers and substrate 1 are aligned and registered at alignment means 13. The multiple dye carriers and substrate are then separated and fed into pre-conditioning zone 3 where the multiple dye carriers and substrate are pre-conditioned by upper 4 and lower 5 and mid 21 infrared emitters and dehumidified by dehumidifying unit 22 to a controlled temperature and humidity. The substrate and multiple dye carriers are then brought into intimate pressured contact 15 at the entrance of and throughout the thermal-imaging zone where they are imaged in the thermal imaging zone 6 according to the present invention. After imaging, the substrate and dye carriers enter the stabilization zone 7 having an upper 9 and lower partition 8 where they are cooled by cooling units 23 and then separated 10 and wound onto their respective rolls 11, 12 and 13.

Figure 3:
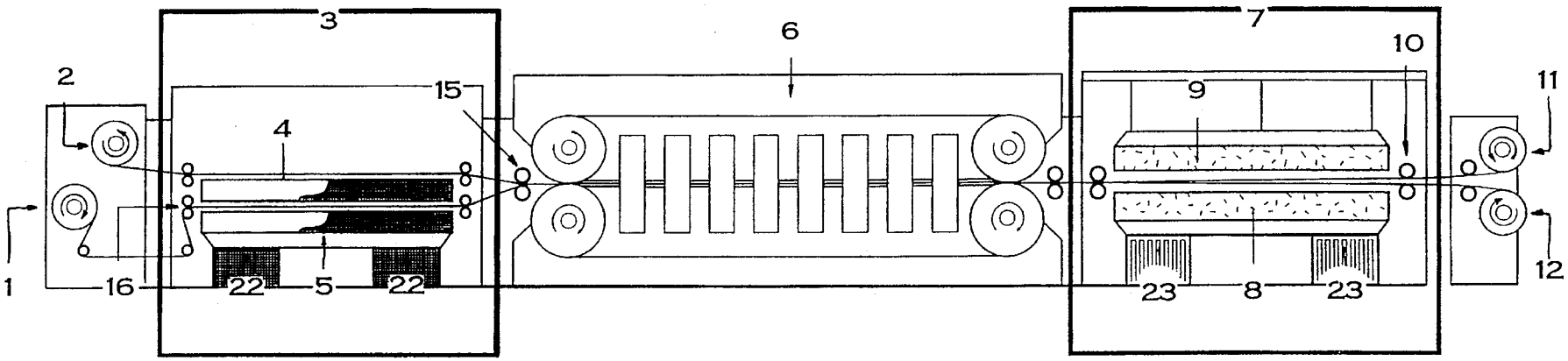
FIG. 3 illustrates a side view of a pre-conditioning and imaging system for imaging a continuous substrate with only the substrate being pre-conditioned.

FIG. 3 illustrates another embodiment of the present invention, where only the substrate is subjected to the pre-conditioning process. The substrate is introduced from supply roll 1 into the entrance 16 of pre-conditioning zone 3, while the dye carrier device 2 remains above and out of the pre-conditioning zone 3. After pre-conditioning, the substrate 1 is brought into intimate pressured contact with the dye carrier device 2 at the entrance 15 and throughout the thermal imaging zone 6 where imaging takes place. The substrate and dye carrier then enter the stabilization zone 7 having an upper 9 and lower portion 8 where they are cooled by cooling units 23 and then separated 10 and wound onto their respective rolls 11 and 12.

Figure 4:
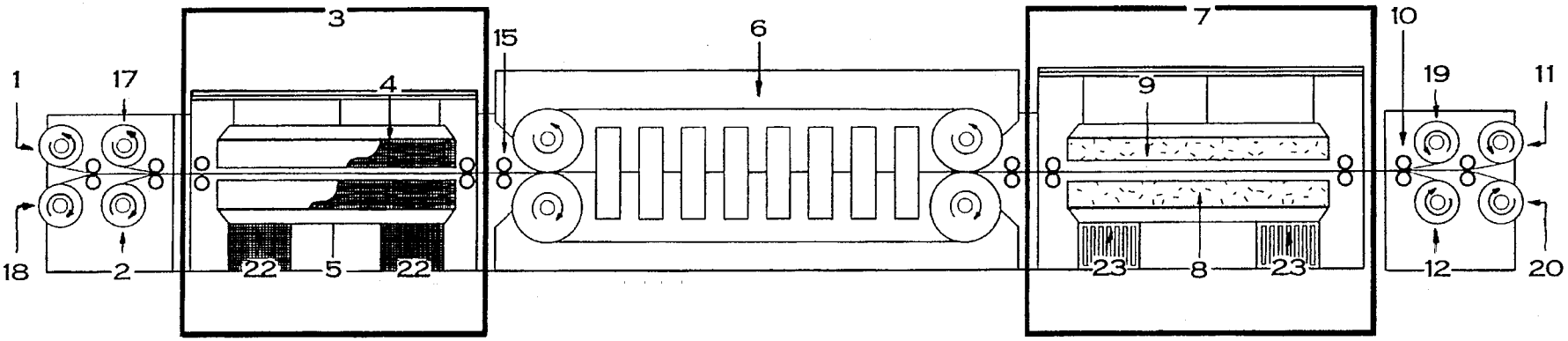
FIG. 4 illustrates a side view of a pre-conditioning and imaging system for imaging two continuous substrates.
Figure 5:
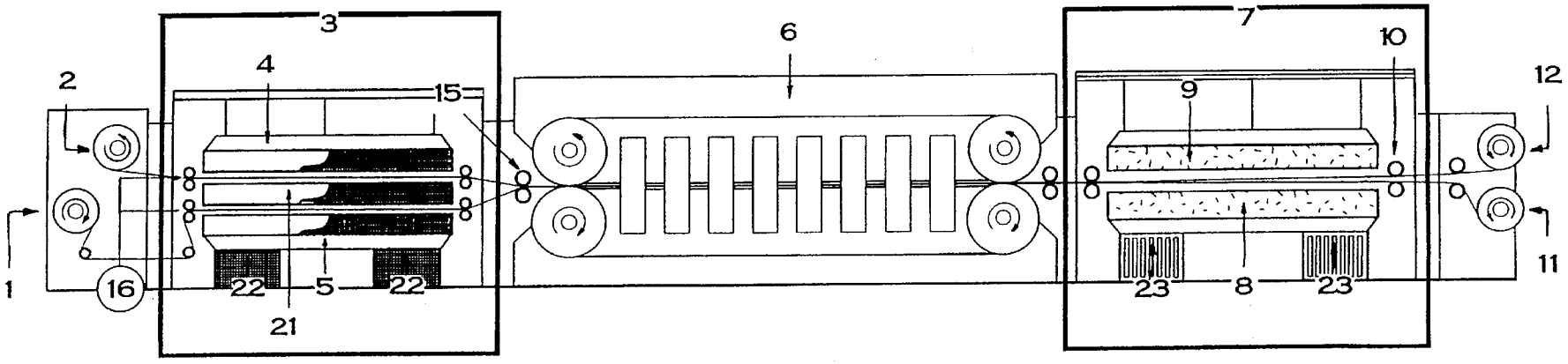
FIG. 5 illustrates a side view of a pre-conditioning and imaging system for imaging a substrate with both the substrate and the dye carrier device being separately pre-conditioned.

FIG. 4 illustrates another embodiment of the present invention, where multiple substrates are imaged. The substrates to be imaged are introduced from supply rolls 1 and 18 along with multiple dye carrier devices 17 and 2 into the pre-conditioning zone 3, where they are pre-conditioned by upper 4 and lower 5 infrared emitters and dehumidifiers 22 to a controlled temperature and humidity. The multiple substrates and dye carriers are then brought into intimate pressured contact 15 and imaged in thermal imaging zone 6. The multiple substrates and dye carriers are then conveyed to stabilization zone 7 having upper 9 and lower portion 8, where they are cooled by cooling units 23 to approximately room temperature. The multiple substrates and dye carriers are then separated and removed by their respective take up roll 11,20,19 and 12.

FIG. 5 illustrates still another embodiment of the present invention, where the dye carrier device and substrate are each subjected to separate pre-conditioning. The substrate on supply roll 1 and the dye carrier device on supply roll 2 are introduced into the entrances 16 of pre-conditioning zone 3. Additional heating devices 21 can be optionally placed between the substrate and dye carrier as shown in FIG. 5 to provide heating from all sides. These additional heating devices allow the dye carrier device to be pre-conditioned at a lower temperature than the substrate being imaged. This is advantageous because a substrate sometimes requires a greater amount of energy for heating, due to the larger dimensions of the substrate. After conditioning, the substrate and dye carrier are brought into intimate pressured contact and thermally imaged, stabilized and retrieved as above.

MATERIALS PROCESSED

In addition to substrates that are capable of being directly imaged without additional coatings, any substrate that is capable of retaining a dye-receptive coating may be imaged according to the present invention. The dye-receptive coating materials are those which are capable of being penetrated by the Sublimable dyes during the thermal imaging process. These dye-receptive coatings preferably include aliphatic, acrylic, polyamine, expoy/amino-amine, acrylic urethane, epoxy polyamidoamine, modified cycloaliphatic/aliphatic amine epoxy, aliphatic urethanes, and alkyd based coatings. Any other dye-receptive coating may also be used in the present invention.

Examples of dye-receptive coatings are unpigmented aliphatic polymer powder coatings such as clear powder coatings sold under the trade name 6C105 and 156C105 both available from Glidden Corporation, Charlotte, N.C. Powder coatings sold under the trade name PFC 40059 Crystal Clear available from O'Brien Powder Coatings, Houston, Tex. may also be used.

Other preferred coatings are aliphatic urethane coatings sold under the trade names Kolorane Enamel U-Series, Kolorane Clear Enamel U-1-5227 and Kolorane Stainless Steel Enamel U-2-S available from Keeler and Long Coatings, Watertown, Conn. Acrylic urethane coatings sold under the trade name Acrythane Enamel Y-Series and Acrythane Hi-Solids Enamel YHS-Series also available from Keeler and Long Coatings are also preferably used.

Other preferred coating materials include moisture cure urethanes sold under the trademarks "MC-Zinc" (zinc-rich) "MC-CR" (primer/topcoat) "MC-Ferrox B" "MC-Mionzinc" and "MC-Aluminum." Still other preferred coatings include moisture curing aliphatic urethanes sold under the trademarks "MC-Luster", "MC-Shieldcoat", "MC-Ferrox A", "MC-Aroclear", "MC-Antigraffiti Clear" and "MC-Clear." Other preferred coatings include moisture curing high-solids urethanes sold under the trademark "MC-Conseal" and moisture curing aromatic such as those sold under the trademark "MC-Aroshield." All the above coatings are available from Keeler and Long Coatings.

Other preferred coatings include thermoset fluoropolymers sold under the trademark "Megaflon" (both the MS and MC series) also available from Keeler and Long Coatings. Other preferred coatings include polyamide epoxy coatings such as those sold under the trade name Kolor-Poxy Primer No. 3200 and Kolor-Poxy Self-Priming Surfacing Enamel both available from Keeler and Long Coatings.

Other urethane based coatings sold under the trade names Eco Dex 4020-W16M, Clear Coating 4820-A20M and Microflex 8510-A59M all available from Dexter Coatings, Waukegan, Ill. may also be used as dye-receptive coatings.

For a substrate which is clear or a color that is unsuitable or undesirable as a background for the printed image, a pigmented coating, such as a coating containing $TiO_2$ or any other suitable pigment, is often applied to the substrate to provide a suitable platform or background for the image to be applied pre or post process. However, most pigmented coatings are not particularly dye-receptive due to the presence of the pigment. Therefore, a clear coating such as those described above may be applied over the pigmented coating. The sublimable dyes migrate and penetrate into the clear coating during the sublimation process. Examples of pigmented dyes include white powder coatings, such as pigmented aliphatic thermoset coating powders sold under the trade name 5W174 and 155W174 both available from Glidden Corporation as well as the 6000 series (urethane white) from Keeler and Long.

The coatings are generally pre-conditioned at a temperature of 200°–500° F. preferably 275°–450° F. and more preferably 300°–425° F., depending on the coating and the temperature performance of the underlying substrate. The relative humidity ranges in the pre-conditioning zone are 0–100%, preferably 0–60%, more preferably 0–40%. The coatings are then imaged at a temperature 250°–500° F., preferably 325°–425° F. most preferably 350°–400° F. and a pressure preferably in the range of 1–50 psig depending on the coating composition and the underlying substrate.

Carbon steel can also be imaged according to the present invention. Any carbon steel, such as steel from Dynatrends, Inc., Southfield, Mich., can be imaged. To image steel, the steel is preferably cleaned, degreased, primed and coated with any of the coatings described above according to techniques known per se. The coated steel is then transferred to the pre-conditioning zone where it is generally conditioned at a temperature of 200°–500° F., preferably 300°–425° F., more preferably 350°–400° F. The relative humidity in the conditioning zone is preferably 0–60%, more preferably 0–50%, most preferably 0–40% relative humidity.

After the pre-conditioning zone, the steel is transferred to the thermal imaging zone where the dye carrier is brought into intimate pressured contact with coated surface of the steel. The thermal imaging is performed at 250°–500° F. preferably 350°–425° F. most preferably 375°–400° F., depending on the coating composition employed. The pressure is preferably in the range of 5 to 50 psig. Higher temperatures may be employed which will shorten dwell time and reduce the pressure required to accomplish dye migration into the coated surface. The imaged steel and dye carrier device are transferred to a stabilization zone, separated and retrieved.

The dyes used in the following examples were: Disperse Blue-309, Disperse Blue-305, Disperse Red-60, Disperse Yellow-54, Disperse Orange-22, Disperse Brown-05, Disperse Blue-60, Disperse Black-CK, Disperse Yellow-86, Disperse Orange-29, and Black which is a mixture of Disperse Blue-305 and Red 60, all available from Crompton and Knowles.

EXAMPLE 1

Carbon steel obtained from Dynatrends was cleaned and degreased and placed into a priming tank of zinc oxide. The cleaned and primed steel was then powder coated by an electrostatic method using Glidden 5W174 white powder coating having a particle size of 7–10 μm. The coating was cured according to the manufacturer's suggested time and temperature. The steel was then clear coated with Glidden "6C105" clear powder coating having a 7–10 μm size. This coating was also cured according to the manufacturer's suggested time and temperatures. Then an additional 15 to 20 minutes of cure time was performed to cure and dry the coatings. The two-part-coated steel (white/clear) was then placed into the pre-conditioning zone and heated to 350° F. The steel was then transported to a thermal imaging zone which was a platen press. The platen press was maintained at 375° F., 50 psig for 1 minute with the steel in intimate contact with a dye carrier device to allow the dyes to sublime and migrate into the surface of the coated steel. The imaged steel and dye carrier device were transported to a stabilization zone where they were cooled, separated and retrieved, producing a multicolored imaged powder coated steel. The transfer of the dyes from the dye carrier to the powder-coated steel was complete and the imaged steel displayed sharp vibrant colors.

Comparative Example 1

Steel was prepared according to Example 1, except that the pre-conditioning process was omitted. The powder-coated steel was placed into the thermal imaging zone platen press in intimate contact with a carrier device at 350° F. 50 psig for 5 minutes. When the steel was initially placed into the platen press, the temperature dropped to 250° F. due to the absorption of the heat by the steel. The platen press slowly recovered after 2 minutes to 350° F., where the dyes were sublimed and migrated into the surface of the coated steel. The powder-coated steel and dye carrier device were removed from the thermal imaging zone, separated and retrieved producing an incomplete multi-colored imaged powder-coated steel. The image in the powder-coated steel did not display the sharp, vivid colors obtained in Example 1.

Aluminum and aluminum alloys can also be imaged according to the present invention. While any aluminum or aluminum alloys may be imaged, examples of typical grades of aluminum alloys that can be used with the present invention include, GPS H-14, 1100, 1100-H-14, 3003-0dH, 5005, 5052, 5052-H32dH-34, 5084, 5086-H-32, 2024, 6061, 6063, 7075 and others which are available from Reynolds Aluminum, Richmond, Va., Lorin Industries, Muskegon, Mich., and Southern Aluminum, Atlanta, Ga. In addition, specular aluminum, such as specular aluminum available from Lorin Industries may also be imaged.

The aluminum (Al) or aluminum alloy (Al/alloy) is first anodized according to conventional anodizing processes. The variables in the anodizing process may be varied to produce desired thicknesses and densities of the anodic coating. The current density during the anodizing process is 10 to 24 amps, with 12 amps being preferred. The anodized Al or Al/alloy is then rinsed free of electrolyte and allowed to dry in a clean environment. The anodized Al or Al/alloy is then transported to the pre-conditioning zone where it is generally thermally conditioned at a temperature of 200°–400° F. preferably 250°–375° F., more preferably 275°14 350° F. The relative humidity of the conditioning zone is preferably 0–50%, more preferably 0–40%, most preferably 0–20% relative humidity. The anodized Al or Al/alloy is then transported to a thermal imaging zone where the dye carrier device is brought into intimate pressured contact. The Al or Al/alloy is then imaged at a temperature of 275°–400° F. preferably 325°–375° F. more preferably 340°–360° F. and a preferred pressure of 5 to 50 psig. The imaged Al or Al/alloy and dye carrier device are then removed, stabilized in a stabilization zone and then separated.

After the imaging and stabilization is complete, the imaged anodized aluminum is preferably sealed in a nickel acetate solution of 5 to 10 grams per liter of solution at a temperature of 180° to 220° F. for 30 to 45 minutes. The imaged anodized aluminum may also be sealed by a steam bath for 45 to 60 minutes or other known sealing methods. This sealing by steam may be in addition to or an alternative to nickel acetate sealing.

EXAMPLE 2

5052 aluminum was anodized using sulfuric acid electrolyte at 175 grams per liter with a current density of 12 amps. The aluminum was processed for 45 minutes to establish an open pore anodic film thickness of 0.8 mil. The anodized aluminum was rinsed free of electrolyte with a clear water rinse followed by a deionized water rinse and then allowed to dry in a clean environment. The open pore anodized aluminum was then placed into the pre-conditioning zone and heated to 325° F. The aluminum was then transported to a platen press thermal imaging zone. The platen press was maintained at 350° F. 50 psig for 1 minute with the aluminum in intimate pressured contact with a dye carrier device to allow the dyes to sublime and migrate into the anodized aluminum. The imaged aluminum and dye carrier device where transferred to a stabilization zone where they were cooled, separated and retrieved, leaving a multi-colored imaged surface. The transfer of the dyes from the dye carrier to the anodized aluminum was complete and the imaged aluminum displayed sharp, vibrant Colors. The imaged aluminum was then sealed using the techniques described above.

Comparative Example 2a

Anodized aluminum was placed into a platen press thermal imaging device in intimate pressured contact with a dye carrier device that was maintained at 420° F. with 50 psig for 2 minutes. The process was performed according to conventional industry standards for high energy disperse dye sublimation techniques for textiles. The aluminum was removed and separated from the dye carrier device after the appropriate time. Inspection of the aluminum revealed cracks on the surface of the anodic coating caused by difference in expansion and contraction of the base aluminum and anodic coating. The multicolored anodic coating displayed unsatisfactory quality and appearance.

Comparative Example 2b

Aluminum was prepared according to Example 2, except that the pre-conditioning process was omitted. In view of the fact that the anodic surface of the aluminum had cracked and crazed at high sublimation temperatures in Comparative Example 2a, the anodized aluminum was placed into the thermal imaging zone platen press in pressured intimate contact with the carrier device at 350° F. for 2 minutes at 50 psig with the aluminum in intimate contact with a dye carrier device. The imaged anodized aluminum and dye carrier device were removed from the thermal imaging zone, separated and naturally cooled to room temperature producing a multi-colored substrate surface. The image in the anodized aluminum did not display the sharp, vivid colors obtained in Example 2.

EXAMPLE 3

Aluminum was anodized in a sulfuric acid bath at 175 grams per liter with a current density of 12 amps per square foot for 45 minutes while being maintained at a temperature of 72° F. The completed anodized aluminum with an anodic coating of about 0.85 mil was removed from the sulfuric acid bath and rinsed free of electrolyte. The aluminum was then dried to provide a clean, open pore anodic surface capable of dye migration and penetration.

The dye carrier device that delivers the color/dye to the surface of the material was prepared on a 55 g $m^2$ bleached kraft paper. The paper was coated with a bone gelatin protein material to enhance non-porous performance. Aqueous inks were prepared according to the present invention from the necessary dyes consisting of color index disperse yellow 54, red 60, blue 305, blue 309, orange 22, brown 05, and black produced from the combination of blue 305 and red 60. The aqueous inks were printed on the coated paper through a multi-station rotogravure printing process using registered etched cylinders to build up a multicolored floral design. The aqueous inks were sealed on the dye carrier device with a thermoplastic polymer to inhibit premature dye contamination and promote efficient dye migration and penetration.

The anodized aluminum and dye carrier device were delivered to the thermal imaging processing line where they were inserted into the pre-conditioning zone entry. The pre-conditioning zone was controlled at 325° F. with a 40% relative humidity for the aluminum, and 150° F. with 40% relative humidity for the dye carrier device. After pre-conditioning, both the aluminum and dye carrier device were transported to the thermal imaging device where the dye carrier device was placed in intimate pressured contact at 50 psig with the anodized aluminum. The dyes located On the dye carrier device were sublimed at 350° F. for 1 minute and migrated and penetrated into the open pores of the anodic coating on the anodized aluminum.

The imaged anodized aluminum and exhausted dye carrier device were then transported into the material stabilization zone where they were rapidly cooled to a temperature of approximately 200° F. which is below the point of sublimation of the dyes, thus, effectively ceasing the activity of the disperse dyes transition to vapor state. The stabilized materials were then separated and recovered to their respective stations. The completed imaged anodized aluminum displayed a multi-colored floral design. The transfer of the dyes from the dye carrier to the anodized aluminum was complete and the imaged aluminum displayed sharp, vibrant colors. The completed imaged anodized aluminum was then sealed in a nickel acetate solution of approximately 4 to 8 grams per liter with cobalt-acetate and boric acid additives to yield the necessary pH factor.

Polymeric products such as plastics can also be imaged according to the present invention. Any polymer capable of accepting a sublimable dye can be imaged according to the present invention. Examples of suitable polymers include polyester, acrylic polymers, polypropylene, polyvinyl chloride, polyurethane, polyethylene terephthalate and suitable mixtures and blends of polymers.

Preferred polymers include polymers sold under the trademark "Lexan", which are thermoplastic polycarbonate condensation products of bisphenol-A and phosgene, available from the General Electric Company, Bridgeport, Conn. Examples of suitable "Lexans", include 8040 MC, 8010 MC, 8040, FR 83, DL 1895, 8B35-112, 8010 ME, and HPXXh Lexan. Other preferred polymers include polymers sold under the trademark "Ultem" which are thermoplastic polyethermides materials. Examples of suitable "Ultems" include DL 1648, DL 4151, and Ultem 1668-A-(Aircraft), also available from the General Electric Company.

Still other preferred polymers include polymers sold under the trademark "Valox", which are thermoplastic polybutylene terephthalate materials. Examples of suitable "Valox" include Valox FRI and Valox 365, also available from the General Electric Corporation. Other preferred polymers include polymers sold under the trademark "Kydex" (100, 6200, 6565 and the 150 series), an acrylic-PVC alloy available from the Kleerdex Company, Mount Laurel, N.J.; and polymers sold under the trademark "Melinex" (Melinar 5122C, Melinex 475, 3050, 375, 329, 339, 357, and S-500), which are polyester synthetic films stretched and heated during manufacturing to improve strength, available from ICI Films, Hopewell, Va.

Polymers sold under the trademark "Mylar" (Mylar J502, EB 11 and GA 848), a polyethylene terephthalate, available from DuPont, Wilmington, Del. and other polyethylene terephthalate films sold under the trademark "Naplam" and "Velobind" available from General Binding Co., Addison, Ill. may also preferably be used according to the present invention. In addition, "Tedlar" which is the trademark for polyvinyl fluoride sold by DuPont can also be successfully imaged according to the present invention When a white background is desired, polymer materials which crystallize and turn opaque, such as polyethylene terephthalate (PET), can be advantageously used in the present invention. The pre-conditioning zone raises the temperature of the PET and causes the normally amorphous PET to undergo crystallization. The crystallization cause the clear PET to become opaque. The opaque PET can then be imaged according to the present invention to produce an imaged product with a white background. The crystallization eliminates the need for an additional white component, such as a white coating described above, when a white background is desired. The PET can also be blended or mixed with other polymer materials in a ratio Sufficient to cause crystallization upon heating to produce a desired selective color/sheen-of the opaque material. Any PET can be used according to the present invention. Suitable PET is available from Klockner Pentaplast, Gordonsville, Va. Modified PET such as APET and PETG may also be used to according to the present invention.

To image polymeric materials, the material is placed in the pre-conditioning zone. The pre-conditioning is generally carried out at a temperature sufficient to raise the surface energy levels to the optimum level where the surface of the material will be receptive to the dyes and accelerate production line speeds. The pre-conditioning is generally carried out at a temperature of 250°–500° F., preferably 300°–450° F., more preferably 325°–400° F., depending on the specific polymer being imaged. The relative humidity in the pre-conditioning zone is preferably 0–80%, more preferably 0–50%, most preferably 0–20% relative humidity. As described above, for some plastic materials it is preferable to maintain the relative humidity above zero percent in order to control the buildup of static electricity on the surface of the polymer.

As explained above, the pre-conditioning reduces the time, temperature and pressure required to accomplish thermal imaging in the imaging zone due to the materials increased surface energy levels. This conditioning reduces the stress, discoloration, expansion of the materials in the thermal imaging zone, which eliminates the possibility of modifying material performance characteristics, such as brittleness, surface tension, and the structural stability of multi-layered materials. In addition, the pre-conditioning also allows an accelerated materials processing at higher temperature, which can even be greater than the glass transition temperature or degradation temperature, to be used in the thermal imaging zone. This is due to the decreased dwell time that is required in the thermal imaging zone and allows for increased migration and penetration and concentration of the dyes into the surface of the material, thus providing sharper, more vivid colors and increased resolution.

After pre-conditioning, the polymeric material is transferred to the thermal imaging zone, where the dye carrier device is brought into intimate pressured contact with the material. The polymeric material is then imaged at a temperature of 250°–500° F. preferably 325°–400° F., more preferably 335°–375° F. and a preferred pressure of 1 to 50 psig depending on the specific polymer material imaged. The imaged material is then cooled in the stabilization zone, separated and retrieved, providing a multi-colored polymer material with sharp vibrant colors.

EXAMPLE 4

"Kydex" plastic material was placed into the pre-conditioning zone and heated to 275° F. at 40–60% relative humidity. The conditioned "Kydex" was then transported to a platen press thermal imaging zone. The platen press was maintained at 275° F. at 20 psig to 50 psig for 30 seconds to one minute with the "Kydex" in intimate pressured contact with a dye carrier device to allow the dyes to sublime and migrate into the surface of the "Kydex". The imaged "Kydex" and the dye carrier device were then transported to a stabilization zone which was a cooled platen where the "Kydex" returned to its original rigid state. The "Kydex" and dye carrier device are then removed from the stabilization zone, separated and retrieved producing a multi-colored "Kydex" material. The transfer of the dyes from the dye carrier to the "Kydex" was complete and the imaged "Kydex" displayed sharp, vibrant colors.

Comparative Example 4a

"Kydex" plastic material was placed into a platen press thermal imaging device in intimate contact with a dye carrier device that was maintained at 420° F. with 20 psig for 45 seconds. The process was transformed according to conventional industry standards for high energy disperse dye sublimation techniques for textiles. The "Kydex" material was removed from the thermal imaging device after the appropriate time and displayed unsatisfactory appearance. The unsatisfactory appearance was caused in part by the dye carrier device to becoming permanently attached to the compromised "Kydex" material. In addition to the contamination of the "Kydex" material by the dye carrier device, the "Kydex" material lost its textured surface and expanded beyond its original product dimensions.

Comparative Example 4b

"Kydex" plastic material was placed in intimate pressured contact with a dye carrier device in a thermal imaging zone which was a platen unit. Since the high temperatures used in Comparative Example 4a ruined the "Kydex" material, the platen unit was maintained at 325° F. at 50 psig for 3 minutes to allow the dyes to sublimate and migrate into the "Kydex." The "Kydex" and the dye carrier device were removed from the heated platen and placed in a stabilization zone. Both the dye carrier and substrate were cooled by glass panels which cooled and stabilized the "Kydex" material. The "Kydex" material returned to its rigid state in approximately 30 seconds. The "Kydex" and dye carrier device are then removed, separated and retrieved producing a multi-colored "Kydex." The image in the "Kydex" did not display the sharp, vivid colors obtained in Example 4.

Comparative Example 4c

"Kydex" plastic material was placed in intimate-pressured contact with a dye carrier device in a thermal imaging zone which is a platen unit. The "Kydex" material is imaged at 275° F. and 50 psig for 5 minutes. The results are similar to Comparative Example 4b except in Comparative Example 4c, a lower temperature required increased dwell time.

EXAMPLE 5

The carrier device for delivery of the dyes to the surface of the "Kydex" was prepared in the same manner as Example 3. The "Kydex" material and the dye carrier device were mounted at the thermal imaging processing line. The "Kydex" material was fed into the pre-conditioning zone where the temperature was controlled at 275° F. at 50% relative humidity. The dye carrier device remained outside the pre-conditioning zone where it advanced at the same rate as the "Kydex" material. The dye carrier device was at room temperature with a relative humidity of approximately 70%. After the "Kydex" completed pre-conditioning, it entered the thermal imaging device where the dye carrier device was placed in intimate pressured contact at 15 psig and 300° F. for 30–45 seconds. The dyes on the dye carrier device were sublimed and migrated and penetrated into the "Kydex" material. After thermal imaging was complete, the imaged "Kydex" material and dye carrier device were transferred into the materials stabilization zone where they were rapidly cooled to below 150° F. to stop the molecular conversion of the disperse dyes to their vapor state and to return the "Kydex" material to its original rigid state. The stabilized materials were then separated and recovered to their respective take-up stations. The completed imaged "Kydex" material displays a multicolored design. The transfer of the dyes from the dye carrier to the "Kydex" was complete and the imaged "Kydex" displayed sharp, vibrant colors.

EXAMPLE 6

8½ by 11 inch "Mylar" sheets having a thickness of 5 and 10 mils were preheated in a pre-conditioning zone to 275° F. for 30 seconds. The sheets were transported along with dye carrier devices into an thermal imaging zone platen unit with a top heat source and a mechanical closure. The "Mylar" sheets were imaged at 300° F. and 20 psig for 45 seconds to allow dye sublimation and migration. The sheets and dye carrier devices were removed from the platen, separated and retrieved producing multi-color imaged "Mylar" sheets. The transfer of the dyes from the dye carrier to the "Mylar" sheets was complete and the imaged "Mylar" sheets displayed sharp, vibrant colors.

Comparative Example 6

"Mylar" sheets identical to Example 6 were imaged in a platen unit for 2 minutes at 350° F. and 50 psig. The sheets and dye carrier devices were removed from the platen, separated and retrieved producing multi-colored imaged "Mylar" sheets. The image in the "Mylar" sheets did not display the sharp, vivid colors obtained in Example 6.

EXAMPLE 7

8½ by 11 inch "Tedlar" sheets having a thickness of 5 and 3 mils were preheated in a pre-conditioning zone to 300° F. The sheets were transported along with dye carrier devices into a thermal imaging zone platen unit with a top heat source and a mechanical closure. The "Tedlar" sheets were imaged at 300° F. and 20 psig for 1 minute to allow for dye sublimation and migration into the Tedlar. The sheets and dye carrier devices were removed from the platen, separated and retrieved, producing multi-colored imaged "Tedlar" sheets. The transfer of the dyes from the dye carrier to the "Tedlar" was Complete and the imaged "Tedlar" displayed sharp, vibrant colors.

Comparative Example 7

"Tedlar" sheets identical to Example 7 were thermally imaged in a platen unit for 3 minutes at 325° F. and 50 psig. The sheets and dye carrier devices were removed from the platen, separated and retrieved producing multi-colored imaged "Tedlar" sheets. The image in the "Tedlar" sheets did not display the sharp, vivid colors obtained in Example 7.

EXAMPLE 8

8½ by 11 inch polyester sheets having a thickness of 5 and 3 mils were heated in a pre-conditioning zone to 300° F. at approximately 40% relative humidity. The sheets were transported along with a dye carrier device into a thermal imaging zone platen unit with a top heat source and a mechanical closure. The polyester sheets were imaged at 350° F. and 50 psig for 1 minute to allow for dye sublimation and migration into the polyester sheets. The sheets and dye carrier devices were removed from the platen, separated and retrieved producing multi-colored imaged polyester sheets. The transfer of the dyes from the dye carrier to the polyester sheets was complete and the imaged polyester sheets displayed sharp, vibrant colors.

Comparative Example 8

Polyester sheets identical to Example 8 were thermally imaged in a platen unit for 2 minutes at 350° F. and 50 psig. The sheets and dye carrier devices were removed from the platen, separated and retrieved, producing multi-colored imaged polyester sheets. The image in the polyester and did not display the sharp, vivid colors obtained in Example 8.

Various species of wood can also be imaged according to the present invention. When the wood is imaged, it is preferably first sanded to provide a smooth surface. The wood is then pre-conditioned at a temperature of 250°–450° F., preferably 275°–400° F., more preferably 300°–350° F. The relative humidity of the pre-conditioning zone is preferably 0–80%, more preferably 0–50%, most preferably 0–50% relative humidity. After pre-conditioning, the wood is transported into the thermal imaging zone where the dye carrier is brought into intimate pressured contact with the wood surface. The wood material is then imaged at a temperature of 275°–420° F. preferably 325°–390° F., more preferably 350°–375° F. and a preferred pressure of 1 to 100 psig. After imaging, the wood and dye carrier device are transported to a stabilization zone where they are cooled then separated and retrieved producing a multi-colored wood material.

Alternatively, a two-part coating, such as that described above for steel can be employed for wood. The wood first has a pigmented coating applied, followed by application with a clear coat, having an aliphatic open chain structure. The coated wood is then pre-conditioned and imaged at a temperature at conditions described above or selected based on the coating composition.

During the processing of wood it is important to balance heat, moisture, and pressure used to encourage dye migration and penetration and to prevent cupping and warpage while maintaining the structural integrity of the wood material.

Wood which has already been imaged can also have the dye which has migrated into the surface of the wood removed. The wood is placed into conditioning zone and heated between 325° to 425° F. for several minutes until the imaged design is removed. The wood may then immediately be transported to the thermal-imaging zone for new imaging, or the wood may be imaged later.

EXAMPLE 9

A wood surface which was coated with the two part coating described above was placed into the pre-conditioning zone and heated up to 325° F. The coated conditioned wood was then transported to the platen press thermal imaging zone. The wood was imaged at 350° F. and 20–50 psig for 30 seconds to one minute with the wood in intimate pressured contact with a dye carrier device to allow for the dyes to sublimate and migrate and penetrate into the coated surface of the wood. The dye carrier device and the wood were removed from the thermal imaging zone and the dye carrier device and wood are separated and retrieved producing a multi-colored wood material. The transfer of the dyes from the dye carrier to the coated wood surface was complete and the imaged coated wood displayed sharp, vibrant colors.

Comparative Example 9

Poplar wood was placed in the thermal imaging zone platen unit. The platen unit is operated at 350° F. and 50 psig for three minutes with a dye carrier device in intimate pressured contact to allow for dye sublimation and migration. The dye carrier device had been printed with a multi-colored teak design. When the dye carrier device and the wood were separated and retrieved, a multi-colored teak design was produced in the wood surface. The image in the wood did not display the sharp, vivid colors obtained in Example 9.

Textiles can also be imaged according to the present invention. Any textile capable of accepting a sublimable dye can be imaged, such as PET, polyester, acrylics, nylon, silk and triacetate. Further examples of various fabrics that can be used include, "Dicel" (a continuous filament cellulose acetate yarn), "Tricel" (a triacetate synthetic fiber); polyesters sold under the trademarks "Tricelon", "Cortelle Standard" and "Cortelle HR" as described in Vellins Publication, Great Britain; "Orlon 42" (a polyacrylonitrile (polyvinyl cyanide) synthetic filament), "Nomex" (a high temperature resistant aramid), polyester and polyester blends, polyester "Lycra" (an elastomeric synthetic fiber), "Quiana" (a polyester), nylon 6,6/Lycra blends, "Dacron" (a polyester synthetic fiber)/Wool blends, Polyester/Koratron Sensitized and "Kevlar" (a high strength polyaramid), all available from DuPont, Wilmington, Del.; "Acrilan" (an acrylonitrile synthetic fiber), "Spectran" (a polyester), "Ultron" (a polyester), SEF (Self-Extinguishing Fabric) all available from Monsanto Corporation, Saint Louis, Mo.; and "Celon" (a polyester)-Nylon 6 and "Teklan" (a polyester), both available from Courtaulds, Great Britain.

In addition, fabrics may be coated with a solution of PET or other dye-receptive material which will make non-imagable fabrics imagable, or otherwise improve or enhance imaging capabilities of some fabrics. The textile may be processed continuously. The textile web which is generally wound onto a roll and is fed continuously into a pre-conditioning zone. The processing speed of the web, the length and temperature of the pre-conditioning zone are selected such that the temperature of the textile is generally heated to 250°–500° F., preferably 320°–450° F., more preferably 350°–420° F. The humidity in the pre-conditioning zone is preferably 0–80%, more preferably 0–60%, most preferably 0–40% relative humidity. The web then continues into the thermal imaging zone where it contacts a calendar cylinder. The textile and dye carrier device while continuously traveling are brought into intimate pressured contact at a pressure of 10–50 psig by the calendar cylinder, and heated to a temperature of 300°–475° F., preferably 350°–450° F., more preferably 375°–420° F. depending on the specific textile imaged. After imaging, the carrier device and textile are stabilized and retrieved producing a multi-colored textile material.

EXAMPLE 10

A polyethylene terephthalate (PET) textile web, available from Re-earth, Durant, Okla. was continuously fed into the pre-conditioning zone and heated to 375° F. The web then continued into the thermal imaging zone. The textile web and a dye carrier device were placed into intimate pressured contact by a calendar cylinder. The thermal imaging zone was maintained at 375° F. at 20 to 50 psig for 20 to 40 seconds to allow for dye sublimation and migration and penetration into the textile web. After imaging, the dye carrier device and the imaged textile web were separated, stabilized and retrieved, producing a multi-color designed textile material. The transfer of the dyes from the dye carrier to the textile web was complete and the imaged textile web displayed sharp, vibrant colors.

Comparative Example 10a

A PET textile and a dye carrier were inserted into a thermal imaging platen unit and heated to 350° F. 50 psig for 2 minutes. The PET textile and dye carrier device were removed, stabilized, separated and retrieved, producing a multi-colored textile material. The image in the textile did not display the sharp, vivid colors obtained in Example 10.

Comparative Example 10b

A PET textile web was continuously fed into a calendar roll thermal imaging zone. The web was processed in the thermal imaging zone with a dye carrier device in intimate pressured contact at 410° F., 20 to 50 psig, for 30 seconds to 1 minute. The PET textile and carrier device were removed from the calendar cylinder, stabilized, separated and retrieved, producing a multi-colored textile material. The image in the textile web did not display the sharp, vivid colors obtained in Example 10.

EXAMPLE 11

A 6 by 6 inch square of "Kevlar" textile was heated in a pre-conditioning zone to 300° F. The textile square was transported along with a dye carrier device into a thermal imaging zone platen unit with a top heat source and a mechanical closure. The textile square was imaged at 350° F. and 50 psig for 1 minute. The imaged textile square and dye carrier device were removed from the platen and separated leaving a multi-colored "Kevlar" textile. The transfer of the dyes from the dye carrier to the "Kevlar" textile was complete and the imaged "Kevlar" textile displayed sharp, vibrant colors.

Comparative Example 11

A "Kevlar" textile square identical to Example 11 was thermally imaged in a platen unit for 2 minutes at 350° F. and 50 psig. The "Kevlar" and dye carrier device were removed from the platen and separated leaving a multicolored "Kevlar" textile square. The image in the Kevlar textile did not display the sharp, vivid colors obtained in Example 11.

EXAMPLE 12

A polyester textile was heated in a pre-conditioning zone to 300° F. The textile was transported along with a dye carrier device into a thermal imaging zone platen unit with a top heat source and a mechanical closure. The textile square was imaged at 350° F. and 50 psig for 1 minute. The polyester textile and dye carrier device were removed from the platen unit and separated leaving an imaged multi-colored polyester textile. The transfer of the dyes from the dye carrier to the polyester textile was complete and the imaged polyester textile displayed sharp, vibrant colors.

Comparative Example 12

A polyester textile identical to Example 12 was thermally imaged in a platen unit for 2 minutes at 350° F. and 50 psig. The polyester and dye carrier device were removed from the platen and separated leaving an imaged multi-colored polyester textile. The image in the polyester textile did not display the sharp, vivid colors obtained in Example 12.

Paper is another material that can be processed according to the present invention. Paper materials are often used for packaging goods that are consumed, such as cigarettes and other packaged goods, especially edible goods. Before the present invention, the paper packaging was generally carried out by traditional solvent based ink printing techniques, such as rotogravure printing. One of the problems with traditional printing process was solvent contamination of the consumed product. For cigarettes, this solvent contamination often left undesirable tastes and odors in the cigarettes and cigarette packaging. The present process does away with solvent contamination because the solvents are evaporated from the ink composition as the paper is printed with the sublimable dyes.

While any paper or coated paper capable of accepting a sublimable dye may be used, preferred papers include SBS (sulfonated board stock) and SBS carton stock available from Westvaco, Richmond, Va., ClS (coated one side) stock available from James River Paper, Shorewood, and Richmond Gravure all located in Richmond, Va., and foiled tissue stock available from both James River Paper and Reynolds Aluminum.

To image the paper according to the present invention, the paper is first placed in the pre-conditioning zone. The paper is generally heated to 180°–400° F., preferably 200°–350° F., more preferably 225°–325° F. The relative humidity is maintained at preferably 0–80%, more preferably 0–60%, most preferably at 0–50% relative humidity. After conditioning, the paper is transported to the thermal imaging zone where it is placed in intimate pressured contact with the dye carrier device. The paper is imaged at a temperature of 225°–425° F., preferably 250°–375° F., more preferably 275°–350° F., and a pressure of 1 to 50 psig, depending on the specific paper imaged. The paper and dye carrier device are then transported to the stabilization zone, removed and separated, producing a multi-colored paper product.

EXAMPLE 13

Coated SBS (coated with an 8014 acrylic coating available from Dispersion Specialties, Ashland, Va.) and a dye carrier device enter a pre-conditioning zone controlled at 180° F. with 40% relative humidity. Both are transported to the thermal imaging zone maintained at 300° F., 20 psig for 30 seconds to 1 minute in intimate pressured contact. The SBS and dye carrier device are then cooled in the stabilization zone to approximate room temperature. The SBS and dye carrier device are then separated and retrieved producing a multi-colored SBS material. The transfer of the dyes from the dye carrier to the SBS was complete and the imaged SBS displayed sharp, vibrant colors.

Comparative Example 13a

Coated SBS paper material was placed into a platen press thermal imaging device in intimate contact with a dye carrier device that was maintained at 420° F. with 15 psig for 1 minute. The process was performed according to conventional industry standards for high energy disperse dye sublimation techniques for textiles. The SBS material was removed from the thermal imaging device after the appropriate time. The SBS material and dye carrier device were separated displaying unsatisfactory material appearance (performance) through discoloration (brown) of the surface of the SBS. The SBS had become rigid and brittle causing surface crazing which compromised quality and appearance.

Comparative Example 13b

Coated SBS approximately 11/1000 to 12/1000 of an inch thick is placed into a platen press thermal imaging zone and placed in intimate pressured contact with a dye carrier device. Since the high temperatures used in Comparative Example 13a ruined the SBS material, the paper is imaged at 325° F. and 50 psig for 2 minutes. The paper and dye carrier device are removed from the platen press and separated, producing a multi-colored SBS material. The image in the SBS does not display the sharp, vivid colors obtained in Example 13.

Comparative Example 13c

Coated SBS of an identical composition as Comparative Examples 13a and 13b is placed into a platen press thermal imaging zone and placed in intimate contact with a dye carrier device. The paper is imaged at 350° F. and 50 psig for 1 minutes. The paper and dye carrier device are removed from the platen press and separated, producing a multi-colored SBS material. The image in the SBS does not display the sharp, vivid colors obtained in Example 13.

Glass that is coated with a dye-receptive coating may be imaged according to the present invention. Examples of the various types of glass that may be imaged include laminated, safety, tinted, plate, frosted and tempered glass. The dye-receptive coatings that may be used are those described above. If an opaque background is desired, a two-part (white/clear) coating as described above.

To image the glass according to the present invention, the glass is generally first cleaned to remove its lubricous coating to access the porous surface of the glass. The cleaning agent is any agent that is capable of removing the lubricous coating. The cleaning agent is generally a dilute acid, such as Seagrave HP91 or OH95 Solution, available from Seagrave Inc., Carlstadt, N.J. The glass is then coated. Curing of the coating will depend on the type of coating applied, e.g., moisture cured, thermoset, air cured or other. If a two-part coating is used, the opaque coating is generally applied first, followed by the clear coating. Alternatively, if the imaged design is to be viewed through the glass, the clear coating can be applied and imaged first, followed by an opaque coating to provide the appropriate background for the imaged surface.

After the coated glass is cured, the glass is then placed into the pre-conditioning zone where it is generally heated up to a temperature of 200°–500° F., preferably 300°–450° F., more preferably 325°–425° F. The relative humidity is generally maintained at 0–100%, preferably 0–60%, most preferably 0–40% relative humidity. The conditioned glass is then transported to the thermal imaging zone. The glass is imaged by intimate pressured contact at a temperature of 300°–500° F., preferably 350°–425° F., more preferably 375°–400° F., and a pressure of 1 to 40 psig, depending on the specific glass and coating imaged. The glass and dye carrier are then transported to the stabilization zone and cooled. The glass and dye carrier are then separated and retrieved, producing a multi-colored glass product.

Note that the coated glass may be pre-conditioned and thermally imaged at temperatures that are up to and in some cases in excess of 500° F. The maximum temperature will depend on the glass and coating material being imaged. For example, high temperature thermoset coatings will not be compromised (baked or discolored) at 400°–500° F. due to their ability to withstand high temperatures once they are thermoset.

In addition, glass bottles or containers which are imaged may first be dyed using a solution of chemical water, a mixture of a dye carrier medium, known in the art or a powder coating. Chemical water or powder coating is applied to the bottles and thermoset or cured by various methods. These dyed and coated bottles provide a solid or multi-colored device and platform for a subsequent thermal imaging process.

EXAMPLE 14

A glass table top (18 inch radius, ⅜ths inches thick) available from Binswanger Glass, Memphis, Tenn. was treated with Seagrave HP91 or OH95 solution to remove its lubricious coating. The glass was then coated with a dye-receptive coating or coatings and cured. The coated glass was placed into the pre-conditioning zone and heated to 300° F. The glass was then transported to a platen press thermal imaging zone. The platen press was maintained at 350° F. 5–10 psig for 1 minute with the glass in intimate pressured contact with a dye carrier device. The glass and dye carrier device where transported to a stabilization zone where they were cooled, separated and retrieved, producing a multi-colored imaged glass material. The transfer of the dyes from the dye carrier to the coated glass was complete and the imaged coated displayed sharp vibrant colors.

Comparative Example 14a

Coated glass was prepared according to Example 14, except that the pre-conditioning process was omitted. The glass was placed into the thermal imaging zone platen press in intimate pressured contact with the dye carrier device at 350° F. and 5 to 10 psig. Heat was absorbed by the glass causing the thermal imaging zone temperature to decrease to 250° F. The temperature slowly rose to 350° F over a period of 5 to 7 minutes. The glass and dye carrier device were removed from the platen unit, stabilized, separated and retrieved producing a multi-colored glass material. The image in the coated glass did not display the sharp vivid colors obtained in Example 14.

EXAMPLE 15

A glass 18" table top was prepared for thermal imaging by removing the factory supplied lubricious coating on the bottom surface with a cleaning agent Seagrave HP91 or OH95 solution. The glass was then coated with a clear/transparent aliphatic urethane from Keeler and Long's 5227 series and cured. The dye carrier device, for delivery of the dyes to the surface of the coated glass was prepared in the same manner as Example 3 except that the image was changed to a classical art design.

The glass and dye carrier device were delivered to the thermal imaging processing line where transferred into the pre-conditioning zone. The glass was pre-conditioned at 300° F. at 40% relative humidity while the dye carrier device was pre-conditioned at 150° F. with 50% relative humidity. The dye carrier device and the coated glass were transported to the thermal imaging device where they were placed in intimate pressured contact 15 psig and 350° F. for 1 minute. The dyes on the dye carrier device were sublimated and migrated and penetrated into the urethane coating on the glass. After imaging was complete, the imaged glass and dye carrier device were transported to the stabilization zone where they were cooled to approximately 200° F. to stop the molecular conversion of the disperse dyes to their vapor state.

The stabilized materials were then separated and retrieved to their proper station. The completed imaged glass displays a transparent colored surface. The imaged glass was then coated on the bottom imaged surface with a Keeler and Long 6000 series urethane white (titanium dioxide) coating to provide an opaque bottom surface that caused the deposited image to transmit the color image through the glass to the top surface providing a three dimensional effect that enhanced the visual quality of the completed glass. The completed imaged glass displayed a classical art multicolored design. The transfer of the dyes from the dye carrier to the coated glass was complete and the imaged coated displayed sharp vibrant colors.

EXAMPLE 16

A piece of glass (8×12 inches, ⅜ths inches thick) available from Binswanger Glass, Memphis, Tenn. was treated with Seagrave HP91 or OH95 solution to remove its lubricious coating. The glass was then coated with a dye-receptive coating or coatings and cured. The coated glass was placed into the pre-conditioning zone and heated to 300° F. The glass was then transported to a platen press thermal imaging zone. The platen press was maintained at 350° F., 5–10 psig for 1 minute with the glass in intimate pressured contact with a dye carrier device. The imaged glass and dye carrier device where transferred to a stabilization zone where they were cooled and separated, leaving a multi-colored glass material. The transfer of the dyes from the dye carrier to the coated glass was complete and the imaged coated displayed sharp vibrant colors.

Comparative Example 16

Coated glass was prepared according to Example 16, except that the pre-conditioning process was omitted. The glass was placed into the thermal imaging zone platen press in intimate pressured contact with a carrier device at 350° F. and 5 to 10 psig. Heat was absorbed by the glass causing the thermal imaging zone temperature to decrease to 250° F. The temperature slowly rose to 350° F. over a period of 5 to 7 minutes. The glass and dye carrier device are removed from the platen unit, stabilized, separated and retrieved producing a multicolored glass material. The image in the coated glass did not display the sharp vivid colors obtained in Example 16.

Other embodiments of the invention will be apparent to those skilled in the art from consideration of the specification and practice of the invention disclosed herein. It is intended that the specification be considered as exemplary only and should not be construed in any way as limiting the invention . The true scope and spirit of the invention is indicated by the following claims.

What is claimed is:

1. A method for thermally imaging a substrate with a dispersed dye, said substrate having a contact surface to be imaged and an opposite surface, said method comprising the steps of:

introducing at least one substrate into a controlled heat and humidity pre-conditioning zone, wherein said pre-conditioning zone is at less than or equal to atmospheric pressure;

heat treating said at least one substrate in said pre-conditioning zone by applying heat to said contact surface from the same side of the substrate as said contact surface, at a temperature and humidity, and for a time, sufficient to increase the contact surface energy levels of said at least one substrate to accelerate and optimize absorption of dyes to produce a conditioned substrate, wherein said contact surface is not brought into intimate pressured contact with a dye carrier device in the pre-conditioning zone;

transporting the resultant conditioned substrate and at least one dye carrier device carrying at least one ink composition containing at least one sublimable dye into a controlled thermal imaging zone;

applying pressure to said at least one substrate and dye carrier device to bring the heat treated contact surface and said dye carrier device into intimate pressured contact, and applying heat to effect the migration and penetration of said at least one dye from said at least one dye carrier device to said at least one substrate by sublimation, to produce at least one imaged substrate;

transporting said at least one imaged substrate to a stabilization zone; and cooling said at least one imaged substrate in said stabilization zone.

2. A thermal imaging method according to claim 1, wherein said at least one imaged substrate and said at least one dye carrier device are separated before said at least one imaged substrate is cooled.

3. A thermal imaging method according to claim 1, wherein said at least one imaged substrate and said at least one dye carrier device are separated after said at least one imaged substrate is cooled.

4. A thermal imaging method according to claim 1, wherein said at least one dye carrier device is introduced into said pre-conditioning zone.

5. A thermal imaging method according to claim 1, wherein said at least one dye carrier does not pass through said pre-conditioning zone.

6. A thermal imaging method according to claim 1, wherein said at least one substrate is a substrate coated with a dye-receptive coating, and wherein said at least one coated substrate is pre-conditioned at a temperature of 200° to 500° F. and the pre-conditioned substrate is imaged at a temperature of 250° to 500° F. and a pressure of 1 to 50 psig.

7. A thermal imaging method according to claim 1, wherein said at least one substrate is coated steel, and wherein said coated steel is pre-conditioned at a temperature of 200° to 500° F. and a humidity in of 0 to 60% relative humidity and the pre-conditioned steel is imaged at a temperature of 250° to 500° F. and a pressure of 5 to 50 psig.

8. A thermal imaging method according to claim 1, wherein said at least one substrate is an aluminum or aluminum alloy, and wherein said aluminum or aluminum alloy is pre-conditioned at a temperature of 200° to 400° F. and a relative humidity of 0 to 50% and the pre-conditioned aluminum or aluminum alloy is imaged at a temperature of 275° to 400° F. and a pressure of 5 to 50 psig.

9. A thermal imaging method according to claim 1, wherein said at least one substrate is a polymer material, and wherein said polymer material is pre-conditioned at a temperature of 250° to 500° F. and a humidity of 0 to 80% relative humidity, and the pre-conditioned polymer material is imaged at a temperature of 250° to 500° F. and a pressure of 1 to 50 psig.

10. A thermal imaging method according to claim 1, wherein said at least one substrate is wood, and wherein said wood is pre-conditioned at a temperature of 250° to 450° F. and a humidity of 0 to 80% relative humidity, and the pre-conditioned wood is imaged at a temperature of 275° to 420° F. and a pressure of 1 to 100 psig.

11. A thermal imaging method according to claim 1, wherein said at least one substrate is a textile, and wherein said textile is pre-conditioned at a temperature of 250° to 500° F. and a humidity of 0 to 80% relative humidity, and the pre-conditioned textile is imaged at a temperature of 300° to 475° F. and a pressure of 10 to 50 psig.

12. A thermal imaging method according to claim 1, wherein said at least one substrate is a paper product, and wherein said paper product is pre-conditioned at a temperature of 180° to 400° F. and a humidity of 0 to 80% relative humidity, and the pre-conditioned paper product is imaged at a temperature of 225° to 425° F. and a pressure of 1 to 50 psig.

13. A thermal imaging method according to claim 1, wherein said at least one substrate is a coated glass, and wherein said coated glass is pre-conditioned at a temperature of 200° to 500° F., and the pre-conditioned coated glass is imaged at a temperature of 300° to 500° F. and a pressure of 1 to 40 psig.

14. A thermal imaging method according to claim 1, wherein said heating in said pre-conditioning stage is carried out in an inert atmosphere.

15. A thermal imaging method according to claim 14, wherein said inert atmosphere comprises nitrogen.

16. A thermal imaging method according to claim 1, wherein said pre-conditioning zone is maintained at less than atmospheric pressure.

17. A thermal imaging method according to claim 1, wherein said at least one dye carrier device comprises, a non-porous flexible support and an ink composition printed thereon, wherein said at least one ink composition comprises 5 to 30 parts of said at least one dispersed dye, 5 to 30 parts of a binder, 2 to 20 parts of a water soluble organic solvent and 0.1 to 3 parts of an anti-foaming agent and 30 to 80 parts of water, all parts given in parts by weight.

18. A thermal imaging method according to claim 1, wherein said at least one dye carrier device comprises, a non-porous flexible support and said at least one ink composition printed thereon, wherein said at least one ink composition comprises 5 to 30 parts of said at least one dispersed dye, 2 to 20 parts of a binder, 1 to 12 parts of a polyfunctional fixing agent, 1 to 8 parts of water, and 30 to 80 parts of an organic solvent, all parts given in parts by weight.

19. A thermal imaging method according to claim 1, wherein said at least one dye has an average particle size of about 0.5 to 1 μm.

20. A thermal imaging method according to claim 1, wherein said at least one dye has an average particle size of less than about 0.5 μm.

21. A thermal imaging process according to claim 1, wherein said at least one dye carrier device comprises a first dye carrier device for pressured contact with a first side of said at least one substrate and a second dye carrier for pressure contacting a second side of said at least one substrate.

22. A thermal imaging process according to claim 1, further comprising multiple substrates and multiple dye carrier devices.

23. A substrate thermally imaged with a dispersed dye, said substrate having a contact surface to be imaged and an opposite surface, produced by the process comprising the steps of:

introducing a substrate into a heated and controlled humidity pre-conditioning zone, wherein said pre-conditioning zone is substantially at or less than atmospheric pressure;

heat treating said substrate in said pre-conditioning zone by applying heat to said contact surface from the same side of the substrate as said contact surface, at a temperature and humidity, and for a time, sufficient to increase the surface energy levels of said substrate to accelerate and optimize absorption of dyes to produce a conditioned substrate, wherein said contact surface is not brought into intimate pressured contact with a dye carrier device in the pre-conditioning zone;

transporting the resultant conditioned substrate and a dye carrier device carrying at least one ink composition containing at least one sublimable dye into a controlled thermal imaging zone;

applying pressure to said substrate and said dye carrier device to bring the heat treated contact surface and dye carrier device into intimate pressured contact, and applying heat sufficient to effect the migration and penetration of said at least one dye from said carrier device to said substrate by sublimation to produce an imaged substrate;

transporting said imaged substrate to a stabilization zone; and cooling said imaged substrate in said stabilization zone.

* * * * *